US006380698B1

(12) United States Patent
Dasgupta

(10) Patent No.: US 6,380,698 B1
(45) Date of Patent: Apr. 30, 2002

(54) DEFLECTION YOKE WITH IMPROVED DEFLECTION SENSITIVITY

(75) Inventor: Basab Bijay Dasgupta, San Clemente, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/759,060

(22) Filed: Jan. 11, 2001

(51) Int. Cl.[7] ..... G09G 1/28

(52) U.S. Cl. ..... 315/368.25; 315/368.28; 313/440; 313/421; 335/210

(58) Field of Search ..... 315/3, 368.25–368.28; 313/421, 440, 425, 431; 335/210, 212, 213

(56) References Cited

U.S. PATENT DOCUMENTS 4,376,924 A * 3/1983 Gross et al. ..... 335/210
4,429,254 A * 1/1984 Chang ..... 315/3
4,553,120 A * 11/1985 Dam ..... 335/210
5,453,658 A * 9/1995 Nishino et al. ..... 313/440
6,046,538 A * 4/2000 Hishiki et al. ..... 313/440

* cited by examiner

*Primary Examiner*—Haissa Philogene
(74) *Attorney, Agent, or Firm*—Blakely, Sokoloff, Taylor & Zafman LLP

(57) ABSTRACT

A deflection yoke is described for use in a cathode ray tube, which has an improved deflection sensitivity. The deflection yoke includes a ferrite core, a vertical coil to generate a vertically defecting magnetic field and a horizontal coil to generated a horizontally deflecting magnetic field. The core has a funnel-shaped body with an opening therethrough defining an inner surface. The horizontal coil includes a pair of saddle-type coils positioned in the core such that at least a portion of the horizontal coil is in contact with the inner surface of the core.

25 Claims, 6 Drawing Sheets

DEFLECTION YOKE WITH IMPROVED DEFLECTION SENSITIVITY

BACKGROUND OF THE INVENTION

1. Field of the Invention

The present invention generally relates to a deflection yoke for use in a cathode ray tube, and in particular, to a deflection yoke with improved deflection sensitivity.

2. Description of the Related Art

Cathode ray tubes (CRTs) are used in display devices to produce images. The basic elements of a CRT are a deflection yoke, one or more electron guns, and a phosphor screen. Color applications generally employ three electron guns, one for each primary color—red, green, and blue. Electron beams emitted by the electron guns are deflected by a deflection yoke. Typically, the deflection yoke consists of two pairs of coils in a CRT. One pair deflects the electron beam primarily in the horizontal direction and is called the horizontal coil. The other pair deflects the beam primarily in the vertical direction and is called the vertical coil.

FIG. 1 depicts a CRT 100 which is cylindrically symmetric. The CRT 100 includes a neck region 102, a funnel region 104 and a phosphor screen 106. FIG. 2 depicts a cross-section of a conventional deflection yoke 200 that has a separator 202 located between a vertical coil 204 and a horizontal coil 206. Also included in the deflection yoke 200 is a ferrite core 210 that serves to enhance magnetic fields 212 produced by the coils 204, 206.

One disadvantage associated with the conventional deflection yoke 200 is that the horizontal coil 206 is positioned a defined distance (D1) away from the ferrite core 210 and therefore the amount of benefit the horizontal coil 206 receives from the ferrite core 210 is reduced. Specifically, the horizontal coil 206 is separated from the core 210 by the vertical coil 204 and the separator 202. The separator 202 is usually a funnel-shaped plastic structure that serves to isolate the horizontal coil 206 in the deflection yoke from the vertical coil 204.

Because the phosphor screen of a CRT is usually rectangular in shape, an electron beam from an electron gun going through the area 208 will never hit the phosphor screen, resulting in a poorer deflection sensitivity. One prior art solution solves this problem by introducing a rectangular deflection yoke 300, as shown in FIG. 3. The funnel region 104 of the CRT is still cylindrical but the rectangular deflection yoke 300 sits in the neck area 102 of the CRT. Since an unnecessary region 208 in FIG. 2 is eliminated, the deflection sensitivity (deflection per unit current) is increased and the amount of stored energy ($E=\frac{1}{2} LI^2$) in the yoke 300 is decreased, where L is the horizontal coil inductance and I is the peak horizontal current.

It is well known in the art that when the stored energy of a deflection yoke is lowered or deflection sensitivity is improved, the cost of the deflection circuit is decreased. Also, certain countries (e.g., Japan) will soon require all televisions to satisfy overall power consumption limitations/requirements. It is also known in the art that by increasing the deflection sensitivity, the amount of power consumption required by the deflection circuit may be reduced. Thus, there is market pressure to find methods of lowering the stored energy and improving deflection sensitivity in a deflection yoke.

SUMMARY OF THE INVENTION

In accordance with one embodiment of the present invention, a deflection yoke is provided for use in a cathode ray tube, which has an improved deflection sensitivity. The deflection yoke includes a ferrite core, a vertical coil to generate a vertically defecting magnetic field and a horizontal coil to generated a horizontally deflecting magnetic field. The core has a funnel-shaped body with an opening therethrough defining an inner surface. The horizontal coil includes a pair of saddle-type coils positioned in the core such that at least a portion of the horizontal coil is in contact with the inner surface of the core.

In one embodiment, channels are provided in the core that extend along the entire core length. The channels are configured to receive the vertical coil and is wider towards a large diameter end of the core and narrower towards a small diameter end of the core. By placing a vertical coil within each of the channels, the vertical coils can be supported by the core without significantly affecting the positioning relationship of the horizontal coil with respect the inner surface of the core. In one implementation, more than one half of the outer surface area of the horizontal coil is in contact with the inner surface of the core.

DETAILED DESCRIPTION OF THE INVENTION

Figure 1:
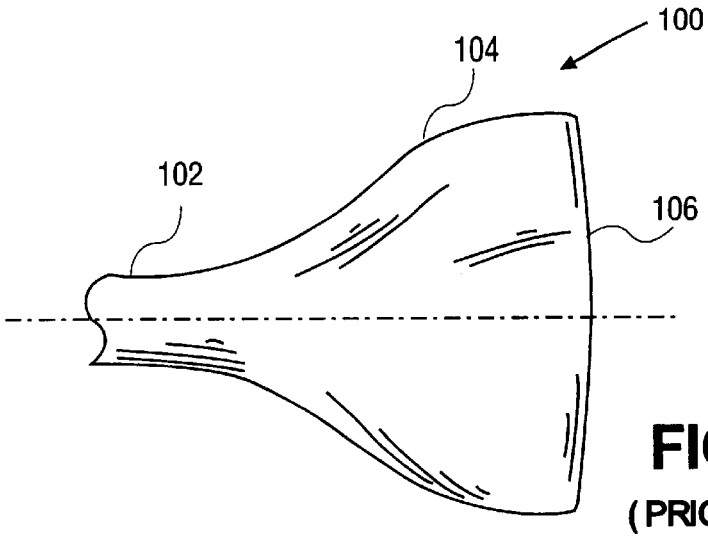
FIG. 1 (PRIOR ART)
FIG. 1 is a schematic side perspective view of a conventional cathode ray tube.
Figure 2:
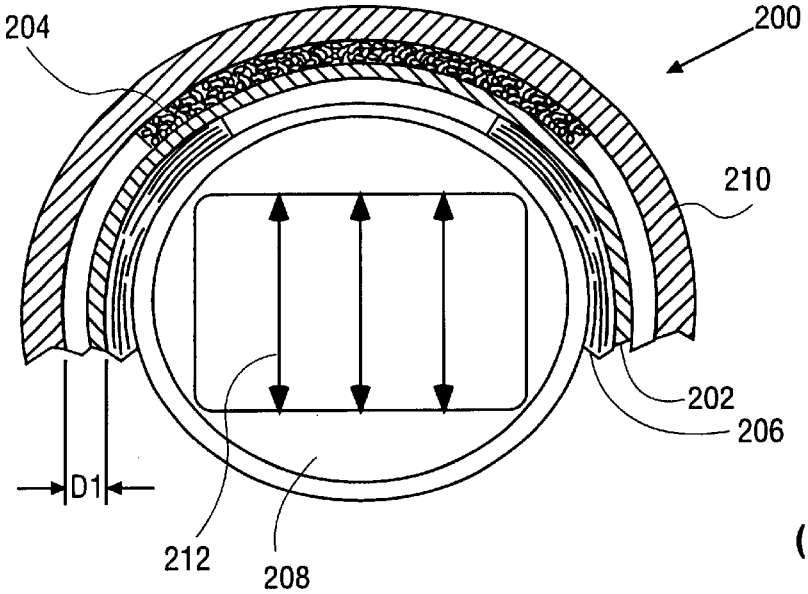
FIG. 2 (PRIOR ART)
FIG. 2 is a cross-sectional elevational view of a conventional deflection yoke.
Figure 3:
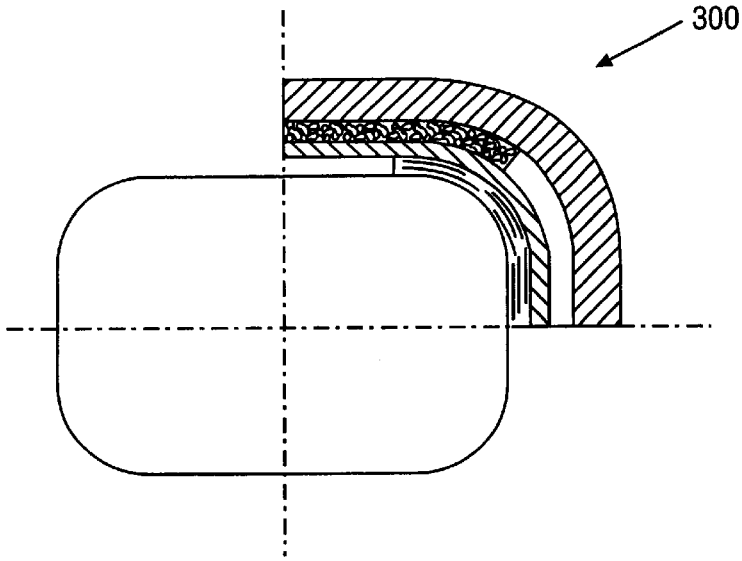
FIG. 3 (PRIOR ART)
FIG. 3 is a cross-sectional elevational view of another conventional deflection yoke with a rectangular type core, illustrating a separation between a ferrite core and a horizontal coil.
Figure 4A:
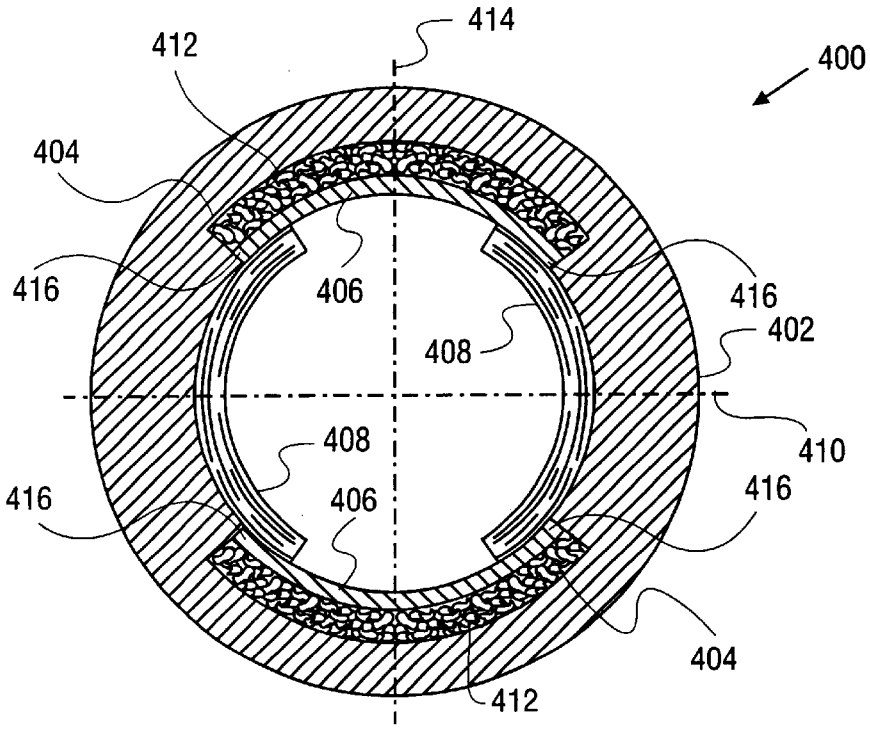
FIG. 4A is a cross-sectional view of a deflection yoke according to one embodiment of the invention.

FIG. 4A depicts a deflection yoke 400 constructed according to one embodiment of the present invention. The deflection yoke 400 generally comprises a ferrite core 402, a vertical coil 404, a liner 406 and a horizontal coil 408. The core 402 is made of a ceramic material (i.e., ferrite material) and serves to enhance the magnetic field produced by the vertical and horizontal coils. The core 402 comprises a funnel-shaped body having a large diameter end and a small diameter end and an opening extending between the large and small diameter ends.

In accordance with one aspect of the invention, the deflection sensitivity of the deflection yoke 400 is improved by reducing or eliminating a separation between a ferrite core and a horizontal coil. The inventor has recognized that by placing the horizontal coil 408 closer to the core 402, the deflection sensitivity of the horizontal coil will increase. Deflection sensitivity is more important for horizontal coils 408 than for vertical coils 404 because an electron beam in a CRT generally scans in the horizontal direction at a rate of 16 KHz and only 60 Hz in the vertical direction. In other words, deflection insensitivity in the vertical direction may not be as critical since the electron beam scans much fewer times per second than in the horizontal direction.

In one embodiment, the horizontal coil 408 comprises a pair of saddle-type coils which are installed against the inner surface of the core 402 such that at least a portion of the horizontal coil is in contact with the core. The location of the horizontal coil portion touching the core is preferably located (i.e., along a central horizontal axis 410) where the effect of the horizontal deflection is most important. In the illustrated embodiment, more than one half of the outer surface area of the horizontal coil 408 is in contact with the inner surface of the core 402.

In accordance with another aspect of the invention, recess regions or channels 412 are provided in the core 402 to receive the vertical coil 404. The channels 412 are located on opposite sides of the core 402 and extend along the entire core length. The channels 412 are arranged substantially symmetrical with respect to a central vertical axis 414 of the deflection yoke 400.

In one embodiment shown in FIG. 4A, the vertical coil 404 comprises a pair of a saddle-type coil disposed within the recess regions 412 of the core. In another embodiment shown in FIG. 4B, the vertical coil 404 comprises a pair toroidal-type coil wound about the channels 412 of the core. A liner 406 is provided in each channel 412 over the vertical coil 404 to electrically separate the vertical and horizontal coils in overlapping regions 416. In one implementation, the liner 406 is constructed of a rigid plastic material configured to provide support for the vertical coil 404. If there are no overlap between vertical coil 404 and horizontal coil 408, the liner 406 may not be needed except, possibly, to provide support. In the illustrated embodiment, the liner 406 only extends over the width of the recessed region 412 and does extend across the entire inner surface of the core.

Figure 5:
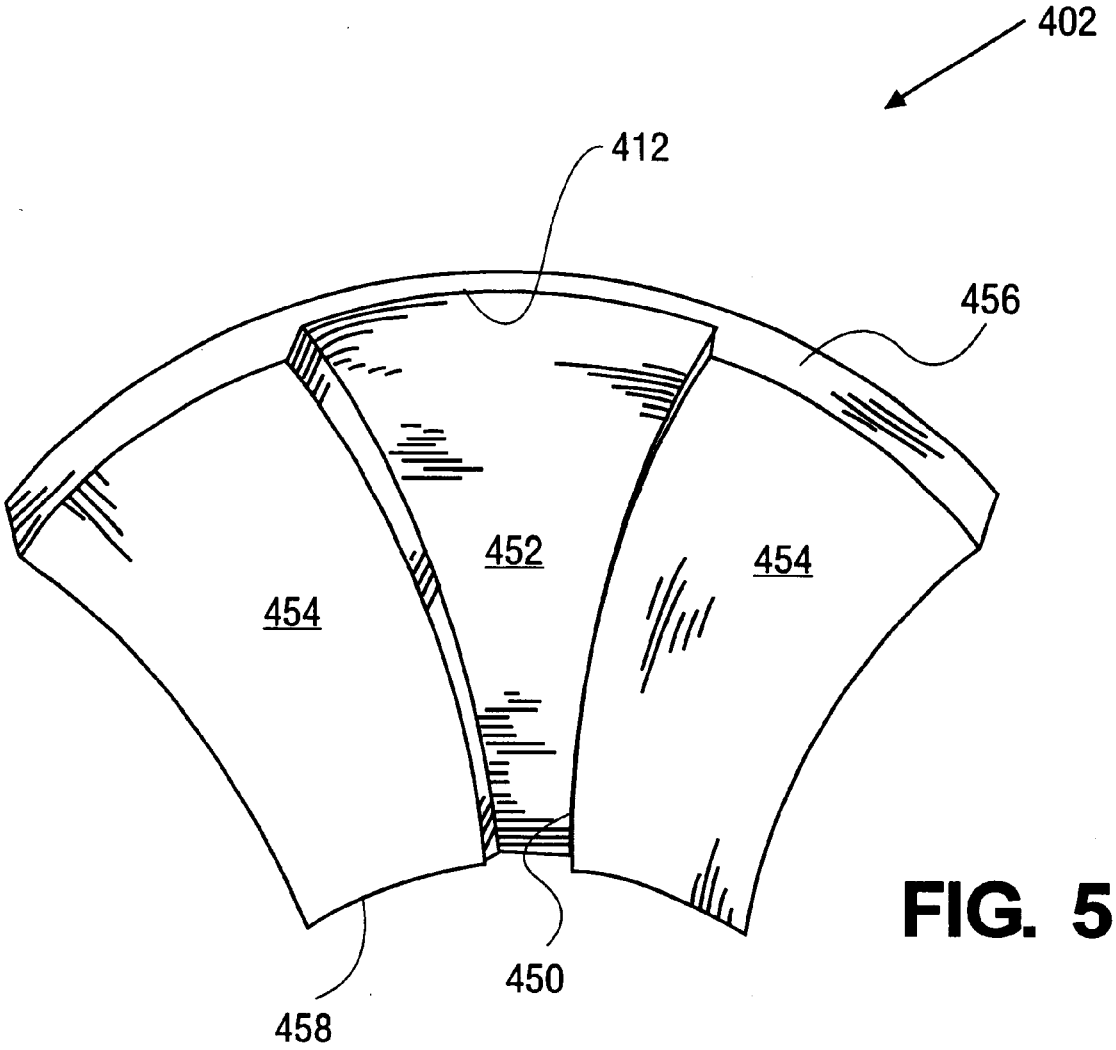
FIG. 5 is a diagrammatic perspective view of a portion of a ferrite core according to one embodiment of the invention, illustrating a channel formed therein for accommodating winding of a vertical coil.

FIG. 5 depicts a portion of a ferrite core 402 according to one embodiment of the invention. The channel 412 formed in the core 402 defines a recessed region 450 having a vertical coil bearing surface 452 that is recessed relative to horizontal coil bearing surfaces 454. The recessed region 412 is shaped to receive a vertical coil. In the illustrated core, the recessed region 412 is wider towards the large diameter end 456 of the core and narrower towards the small diameter end 458 of the core. By placing a vertical coil within the channel 450, the vertical coil windings can be supported by the core without significantly affecting the positioning relationship of a horizontal coil with respect to the horizontal coil bearing surface 454.

Figure 4B:
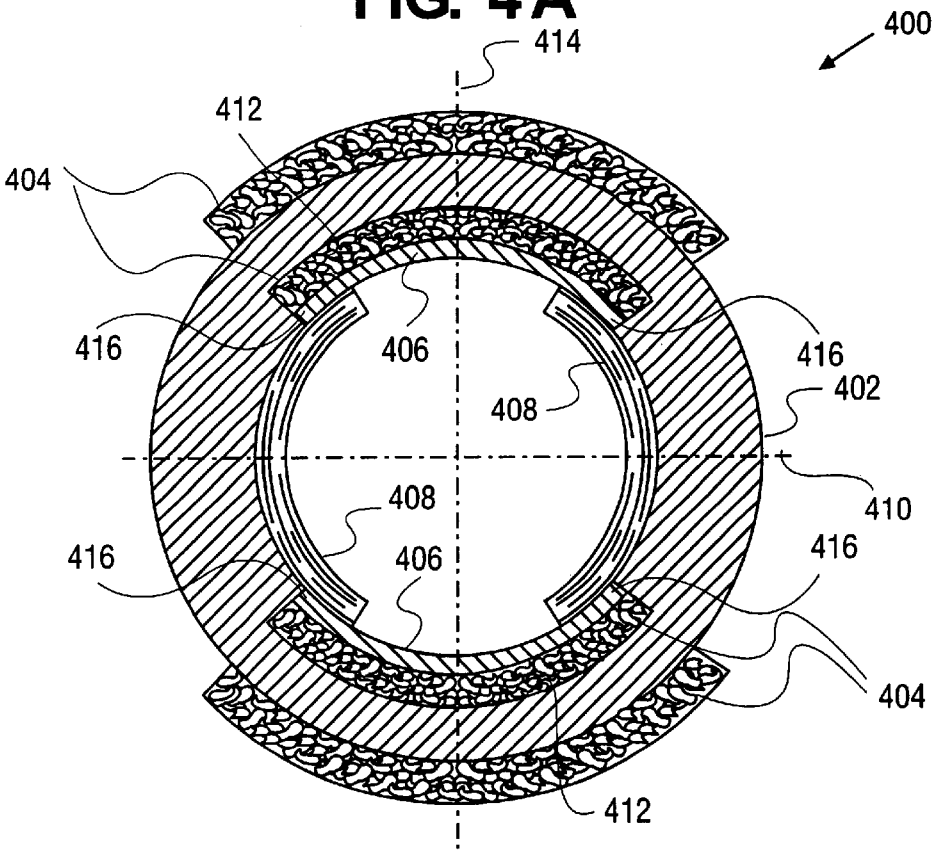
FIG. 4B is a cross-sectional view of a deflection yoke according to another embodiment of the invention.

As shown in FIGS. 4A and 4B, the liner 406 is placed between the vertical coil 404 and the horizontal coil 408 to electrically separate the coils in the overlapping regions 416. In this regard, the depth of the recessed region 450 is selected to accommodate the thickness of the vertical coil winding in addition to the thickness of the liner.

Figure 6A:
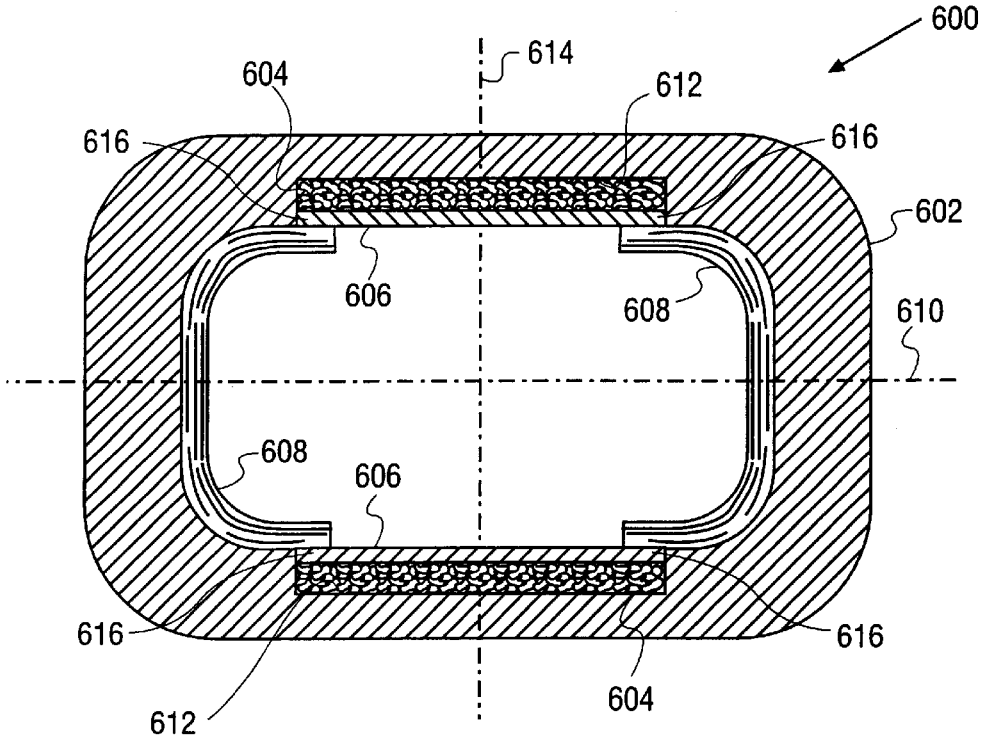
FIG. 6A is a cross-sectional view of a deflection yoke with a rectangular-type core according to one embodiment of the invention.
Figure 6B:
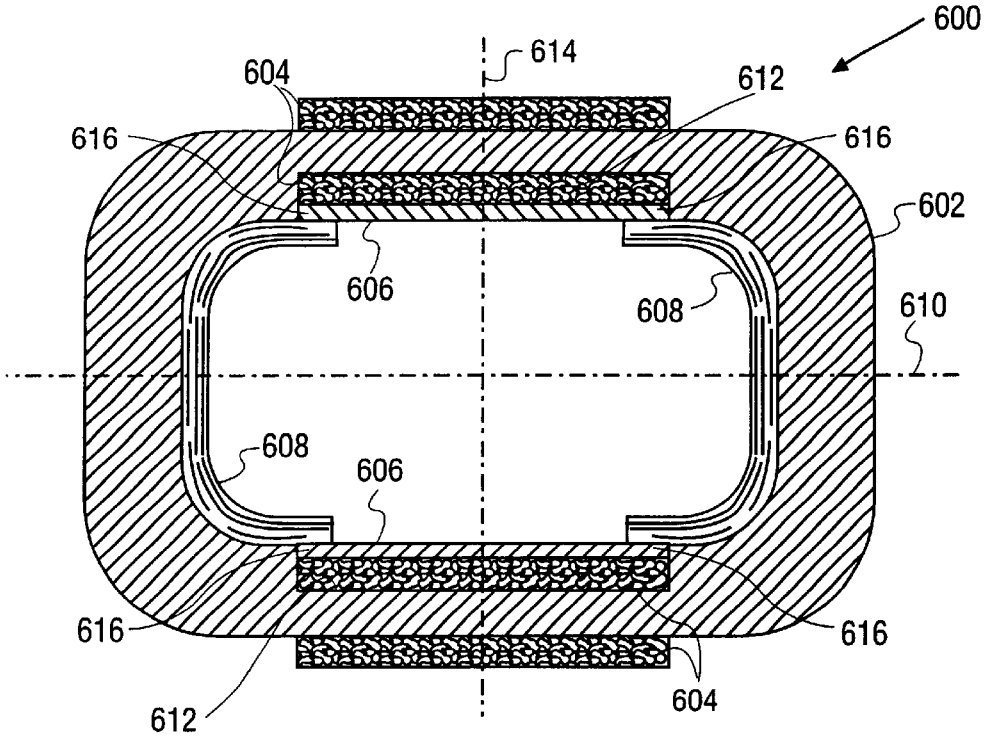
FIG. 6B is a cross-sectional view of a deflection yoke with a rectangular-type core according to another embodiment of the invention.

FIG. 6A depicts a deflection yoke 600 according to one embodiment of the present invention. As discussed above, one way to increase the deflection sensitivity is to construct the neck of a CRT in a rectangular configuration to reduce the leakage of the magnetic field generated by a deflection yoke. The deflection sensitivity of a deflection yoke for such CRT can be further enhanced by incorporating the features of the present invention. In the illustrated embodiments shown in FIGS. 6A and 6B, the cross-section of the core 602 is substantially of a hollow rectangular shape and has channels 612 form in the core 602 to accommodate a vertical coil 604. The deflection yoke 600 also includes a liner 616 to electrically separate the vertical coil 604 from a horizontal coil 608 arranged along the inner surface of the core. In one embodiment shown in FIG. 6A, the vertical coil 604 comprises a pair of a saddle-type coil disposed within the recess regions 612 of the core. In another embodiment shown in FIG. 6B, the vertical coil 604 comprises a pair of toroidal-type coil wound about the channels 612 of the core.

Figure 7A:
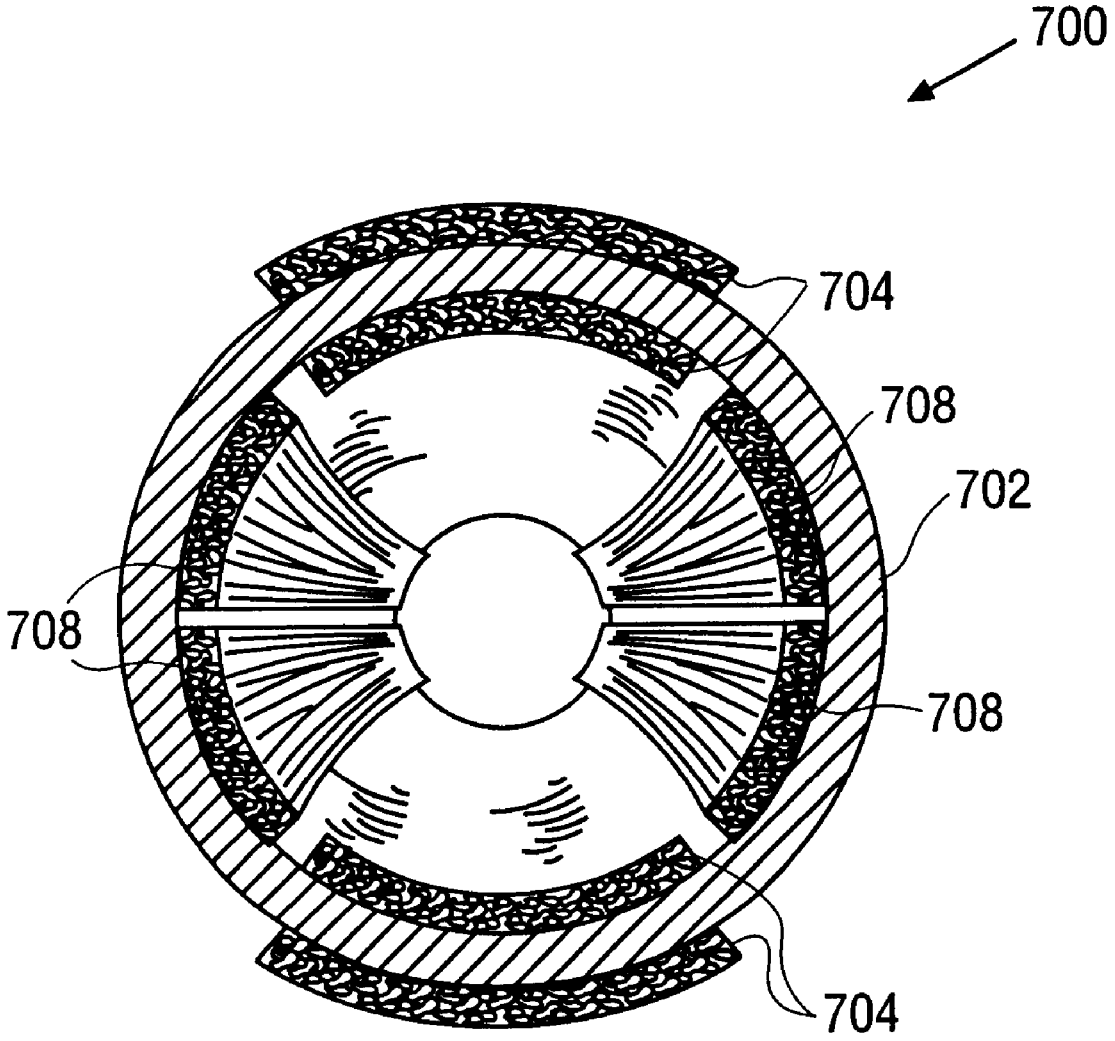
FIGS. 7A and 7B are a cross-sectional elevation view of a deflection yoke having no overlap between horizontal and vertical deflection coils according to an alternative embodiment of the invention.
Figure 7B:
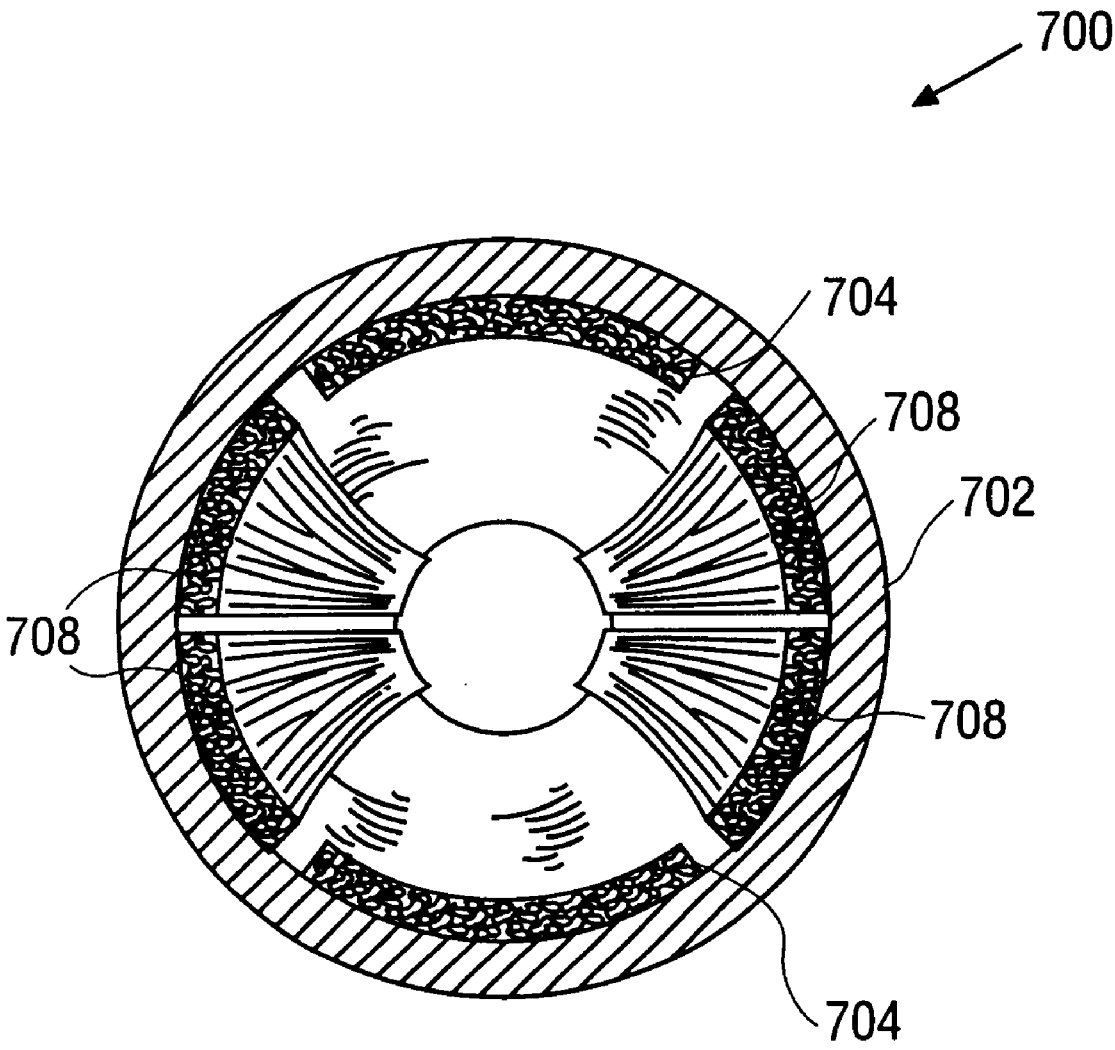

FIGS. 7A and 7B depict a deflection yoke 700 according to an alternative embodiment of the invention. In FIG. 7A, a deflection yoke 700 is shown which has a core 702, a pair of toroidal-type vertical coils 704 wound on the core and a pair of saddle-type horizontal coils 708 arranged inside the core. In FIG. 7B, another deflection yoke 700 is shown which has a pair of saddle-type vertical coils 704 and a pair of saddle-type horizontal coils 708 arranged inside the core 702. Because there is no overlap between the horizontal 708 and vertical 704 coils in the deflection yokes 700 shown in FIGS. 7A and 7B, a liner is not needed except, possibly, to provide support.

While most deflection yokes for color CRTs are configured such that there is usually an overlap between horizontal and vertical deflection coils, some deflection yokes may not require such overlap. For example, a deflection yoke adapted for use in a projection television may not require an overlap between horizontal coils 708 and vertical coils 704. In a projection-type display system, there are generally three CRTs, one for each primary color; red, green and blue. The three tubes or beams converge mechanically or optically at the panel so the deflection yoke is monochrome. Here, because only one electron beam (one color phosphor) is needed, the yoke designer does not have to be concerned about convergence. For this reason, horizontal and vertical coils may be arranged in a deflection yoke without an overlap of horizontal and vertical coils that is usually present in a deflection yoke for a three-electron beam.

In a color display, convergence of the three beams is necessary. Since the horizontal and vertical coils have to be arranged in a particular fashion in order to achieve convergence, it is highly likely that the horizontal and vertical coils will overlap. Nevertheless, convergence of the three beams in a color display may be possible without an overlap of horizontal and vertical coils in certain instances.

According to the invention, by moving the horizontal coil closer to the ferrite core, a number of advantages may be achieved. By improving horizontal deflection sensitivity, the amount of stored energy in the yoke is decreased. As a result, the cost of manufacturing a deflection circuit for the deflection yoke of the present invention is reduced. Additionally, the amount of power consumed by the deflection circuit and the deflection yoke is also reduced.

While the foregoing embodiments of the invention have been described and shown, it is understood that variations and modifications, such as those suggested and others within the spirit and scope of the invention, may occur to those skilled in the art to which the invention pertains. The scope of the present invention accordingly is to be defined as set forth in the appended claims.

What is claimed is:

1. A deflection yoke for use in a cathode ray tube, comprising:

a ferrite core having a funnel-shaped body with an opening therethrough defining an inner surface;

a vertical deflection coil to generate a vertically deflecting magnetic field; and a horizontal deflection coil to generate a horizontally deflecting magnetic field, said horizontal deflection coil including a pair of saddle-type coils positioned in said core such that at least a portion of said horizontal deflection coil is in contact with said inner surface of said core.

2. The deflection yoke of claim 1, wherein said core has channels located on opposite sides of the core and extend along the entire core length.

3. The deflection yoke of claim 2, further comprising a liner disposed in each of said channels such that said vertical deflection coil is sandwiched between said channel and said liner.

4. The deflection yoke of claim 3, wherein said liner serves to provide support for said vertical deflection coil in said channel.

5. The deflection yoke of claim 3, wherein said liner serves to separate said vertical and horizontal deflection coils in regions where said coils overlap.

6. The deflection yoke of claim 1, wherein more than one half of outer surface of said horizontal deflection coil is in contact with the inner surface of said core.

7. The deflection yoke of claim 1, wherein said vertical deflection coil comprises a pair of toroidal-type vertical coils wound on the core, said horizontal deflection coil comprises a pair of saddle-type horizontal coils, and said vertical and horizontal deflection coils are arranged such that there is no overlap between said horizontal and vertical coils.

8. The deflection yoke of claim 1, wherein said vertical deflection coil comprises a pair of saddle-type vertical coils positioned in said core such that at least a portion of said vertical coils is in contact with said inner surface of said core, said horizontal deflection coil comprises a pair of saddle-type horizontal coils, and said vertical and horizontal deflection coils are arranged such that there is no overlap between said horizontal and vertical coils.

9. The deflection yoke of claim 1, wherein a cross-section of said core has a substantially hollow rectangular shape.

10. The deflection yoke of claim 1, wherein a cross-section of said core has a substantially hollow circular shape.

11. The deflection yoke of claim 2, wherein said vertical deflection coil comprises a pair of saddle-shaped coils arrange in said channels formed in said core.

12. The deflection yoke of claim 2, wherein said vertical deflection coil comprises a pair of toroidal-shaped coils wound in said channels formed in said core.

13. The deflection yoke of claim 1, wherein at least a portion of said horizontal deflection coil directly touches with said inner surface of said core.

14. A deflection yoke comprising:

a core having a large diameter end, a small diameter end and an opening extending between said large and small diameter ends to define an inner surface, said core having a first channel and a second channel extending along the entire core length between said large and small diameter ends, said first and second channel having a recessed surface that is recessed relative to the rest of the inner surface of the opening;

a pair of vertical deflection coils disposed against said recessed surface of said channels; and a pair of saddle-type horizontal deflection coils disposed against said inner surface of said core that is elevated relative to said recessed surface, wherein at least a portion of said horizontal deflection coils touches said inner surface of said core.

15. The deflection yoke of claim 14, further comprising a liner disposed in each of said channels such that said vertical deflection coil is sandwiched between said channel and said liner.

16. The deflection yoke of claim 15, wherein said liner serves to separate said vertical and horizontal deflection coils in regions where said coils overlap.

17. The deflection yoke of claim 14, wherein a cross-section of said core has a substantially hollow rectangular shape.

18. The deflection yoke of claim 14, wherein a cross-section said core has a substantially hollow circular shape.

19. The deflection yoke of claim 14, wherein said vertical deflection coil comprises a pair of saddle-shaped coils arrange in said channels formed in said core.

20. The deflection yoke of claim 14, wherein said vertical deflection coil comprises a pair of toroidal shaped coils wound in said channels formed in said core.

21. The deflection yoke of claim 14, wherein more than one half of outer surface of said horizontal deflection coils is in contact with the inner surface of said core.

22. A core for use in a deflection yoke, comprising:

a funnel-shaped body to reflect magnetic field produced by vertical and horizontal coils, said funnel-shaped body having a large diameter end, a small diameter end and an opening extending between said large and small diameter ends, defining an inner portion;

a first channel and a second channel formed in said inner portion of said body extending along the entire core length, each channel defining a recessed region shaped to receive a vertical coil, wherein the depth of said recessed region is selected to accommodate the thickness of the vertical coil in addition to the thickness of a liner electrically separating the vertical coil from the horizontal coil within said recessed region.

23. The core of claim 22, wherein each of said channels is wider towards the large diameter end of the core body and narrower towards the small end of the core body.

24. The core of claim 22, wherein said first and second channels are located on opposite sides of the core opening and are arranged substantially symmetrical with respect to a central vertical axis of the deflection yoke core.

25. The core of claim 22, wherein said funnel-shaped body made of ferrite material.

* * * * *